United States Patent [19]

Widmann

[11] Patent Number: 4,785,609

[45] Date of Patent: Nov. 22, 1988

[54] METHOD OF WRAPPING A FLAT RECTANGULAR ARTICLE

[75] Inventor: Franz-Joseph Widmann, Hilzingen, Fed. Rep. of Germany

[73] Assignee: Sig Schweizerische Industrie-Gesellschaft, Neuhausen am Rheinfall, Switzerland

[21] Appl. No.: 11,438

[22] Filed: Feb. 5, 1987

[30] Foreign Application Priority Data

Feb. 6, 1986 [CH] Switzerland ..... 462/86

[51] Int. Cl.[4] ..... B65B 11/02

[52] U.S. Cl. ..... 53/461; 53/481; 53/482

[58] Field of Search ..... 53/461, 466, 481, 482, 53/229, 378, 465, 491; 229/87 R

[56] References Cited

U.S. PATENT DOCUMENTS

| | | | |
|---|---|---|---|
| 1,398,569 | 11/1921 | Peterson | 53/466 X |
| 1,946,569 | 2/1934 | Clark | 53/482 X |
| 2,152,323 | 3/1939 | Moore | 53/482 X |
| 2,418,277 | 4/1947 | Petskeyes | 53/378 |
| 2,651,578 | 9/1953 | Bodolay et al. . | |
| 2,874,527 | 2/1959 | Cravits | 53/378 |
| 3,499,260 | 3/1970 | Forman | 53/412 |

FOREIGN PATENT DOCUMENTS

| | | | |
|---|---|---|---|
| 254978 | 1/1949 | Switzerland | 53/466 |

*Primary Examiner*—John Sipos

*Attorney, Agent, or Firm*—Spencer & Frank

[57] ABSTRACT

A method of packing a flat, angular item having two opposite large faces, two opposite side faces and two opposite end faces. Each end face is bounded by two short end face edges, a first long end face edge and a second long end face edge. The method includes the steps of laying a wrapper sheet about the two large faces and the side faces to obtain superposed longitudinal edge zones of the wrapper sheet and opposite terminal wrapper portions projecting beyond the end faces; bonding to one another the longitudinal edge zones by a longitudinal seam; flattening the longitudinal edge zones of the wrapper sheet against one of the large faces; folding each terminal wrapper portion about the short end face edges and about the first long end face edge flat against a respective end face, whereby each terminal wrapper portion is coplanar with the respective end face and has an end part projecting beyond a respective second long end face edge; sealing folded parts of each terminal wrapper portion to one another; and folding the end part of each terminal wrapper portion about the second long end face edge flat against the respective end face.

3 Claims, 3 Drawing Sheets

METHOD OF WRAPPING A FLAT RECTANGULAR ARTICLE

BACKGROUND OF THE INVENTION

This invention relates to a method of packing a flat angular item, particularly a chocolate bar which has two opposite large faces (a top and a bottom face), two opposite side faces and two opposite end faces. Each end face is defined by two short end face edges and by two long end face edges. For making the package, a wrapper sheet is laid about the two large faces and the side faces of the item and at the overlapping longitudinal edges of the wrapper a longitudinal seam is formed which is folded flat onto one of the large faces of the item. For forming the wrapper closures at the opposite end faces of the article, the marginal zones of the wrapper which extend beyond each end face are folded about the short end face edges and along a first one of the long end face edges onto the respective end face and sealed to one another. Then the flap at each end of the package is folded about the second long end face edge onto the end face and the projecting portion of each flap is secured to the overlapping part of the package.

A method of the above-outlined type and a package obtained by such method are known and are disclosed, for example, in Swiss Patent No. 254,978. In such a prior art method, the wrapper formed of an aluminum foil coated with a synthetic material is wrapped about the two large faces and the side faces of the item (chocolate bar). The longitudinal edges of the foil are superposed such that they project away from one of the large faces; they are sealed to one another and folded flat onto that large face. Thereafter, by means of a pinch fold, the edge zones of the wrapper projecting beyond the short end face edges are folded inwardly and the edge zone of the wrapper which projects beyond the first long end face edge and which contains one part of the longitudinal seam is folded about the end face onto the edge zone of the wrapper which projects beyond the second long end face edge and are folded down and sealed to one another. As a final step, the closure parts at the opposite end faces of the bar are folded down about the second long end face edge onto that large face which is free from the longitudinal seal.

A package of the above-outlined known type has the advantage that the product is wrapped in a hermetically sealed manner. It is, however, a disadvantage of such a package that the large faces thereof are interrupted by seams or folded edge parts making them unusable for promotional purposes. Therefore, such a package has to be provided with an additional paper sleeve cover which renders the package more expensive and complex.

SUMMARY OF THE INVENTION

It is an object of the invention to provide an improved method and package of the above-outlined type from which the discussed disadvantages are eliminated.

These objects and others to become apparent as the specification progresses, are accomplished by the invention, according to which, briefly stated, the edge zones of the wrapper which are folded and sealed together and which project beyond the end face edges defining the two opposite end faces of the item are folded down onto the respective end face about the respective second long end face edge.

DESCRIPTION OF THE PREFERRED EMBODIMENTS

Figure 1:
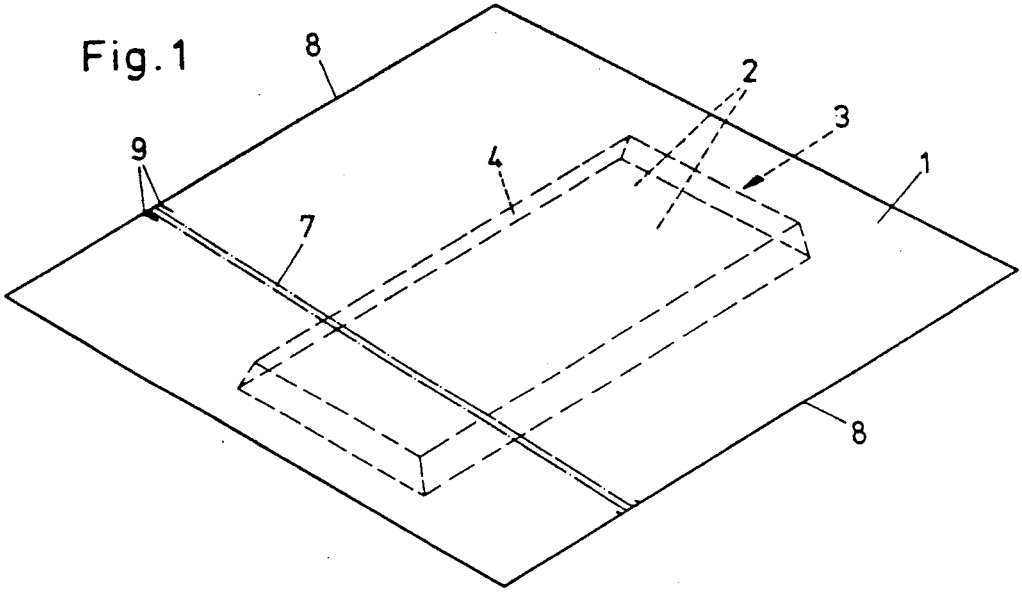
FIGS. 1 and 2 are schematic perspective views illustrating the first and second wrapping steps common to all embodiments.
Figure 2:
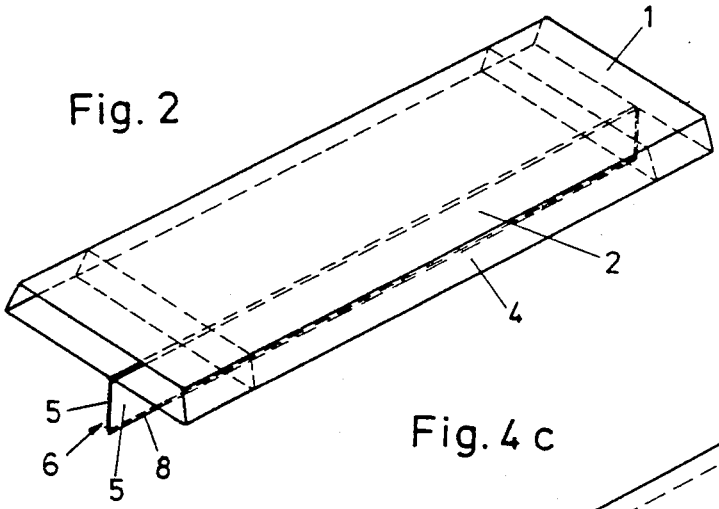
Figure 4C:
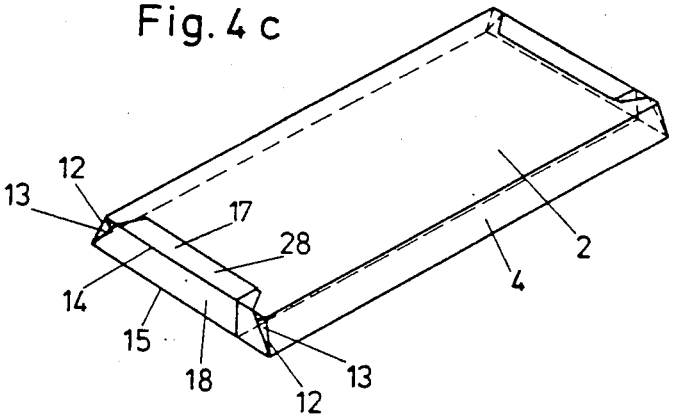
FIG. 4*c* is a schematic perspective view illustrating a fourth step of a third preferred embodiment of the invention.

Turning to FIGS. 1 and 2, first a wrapper sheet 1 provided with a sealing layer is positioned onto the one large face 2 of an item, such as a chocolate bar 3 and is wrapped around the opposite side faces 4 of the bar and placed flat onto the other large face 2 to thus form a wrapper sleeve. The superpositioned longitudinal edge zones 5 of the sheet 1 are sealed to one another whereby a longitudinal seam 6 is provided. To the sheet 1 a tear-open strip 7 is glued which, with the longitudinal edges 8 of the sheet 1 form an angle which is slightly different from 90°. At one longitudinal edge 8 two short slits 9 are provided on either side of the tear-open strip 7. The two steps described in connection with FIGS. 1 and 2 are common to all three embodiments to be discussed below.

Figure 3A:
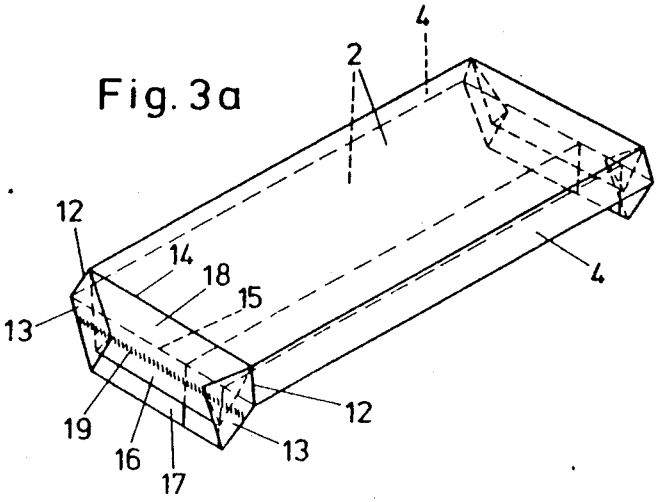

Turning now to the embodiment illustrated in FIGS. 3*a*–6*a*, the wrapper closures at the opposite end faces of the article 3 are formed by first folding the edge zones 13 projecting beyond the short end face edges 12 and the edge zones 16 and 17 projecting beyond the long end face edges 14, 15 flat onto the one and the other end face 18. The lateral edge zones 13 are placed over the edge zone 16 folded about the long end face edge 14. Thus, this closure, unlike that described in Swiss Patent No. 254,978, does not form a pinch fold. The flattened edge zones 13, 16 and 17 of the wrapper sheet 1 are sealed to one another by a sealing seam 19 as shown in FIG. 3*a*.

Figure 5A:
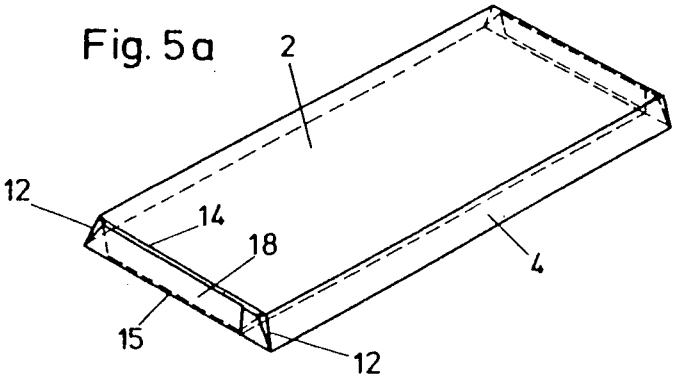
FIGS. 3*a*, 4*a*, 5*a* and 6*a* are schematic perspective views illustrating the third, fourth, fifth and sixth step of a method according to a first preferred embodiment of the invention.
Figure 6A:
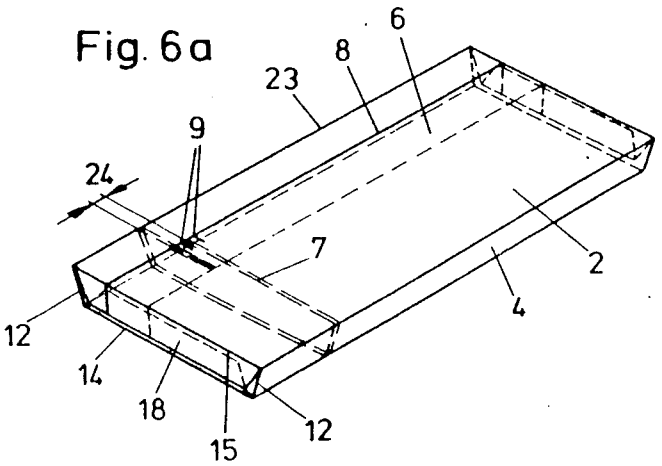
Figure 4A:
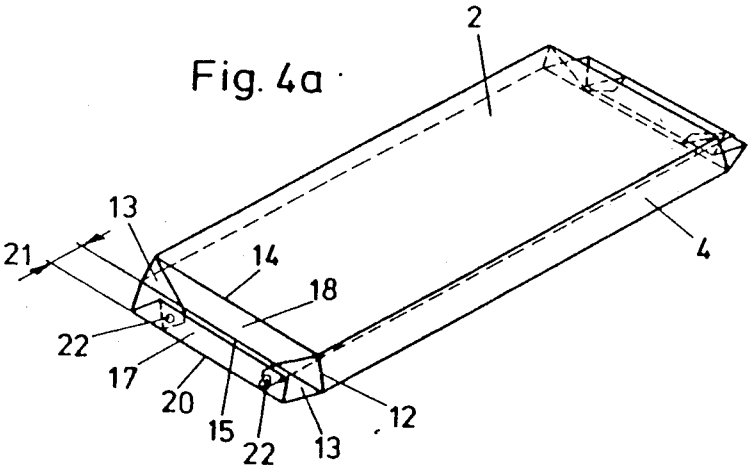
Figure 5B:
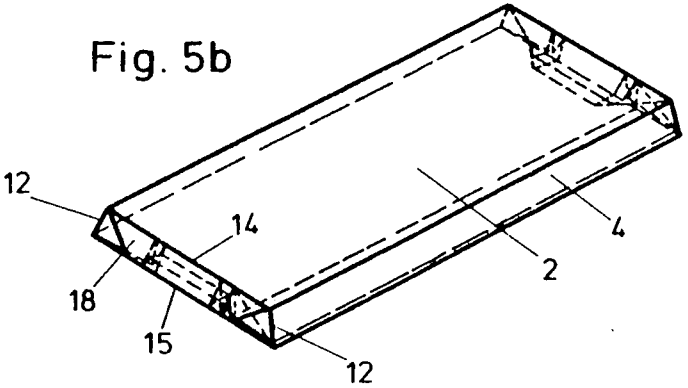
FIGS. 3*b*, 4*b*, 5*b* and 6*b* are schematic perspective views illustrating the third, fourth, fifth and sixth step of a method according to a second preferred embodiment of the invention.
Figure 6B:
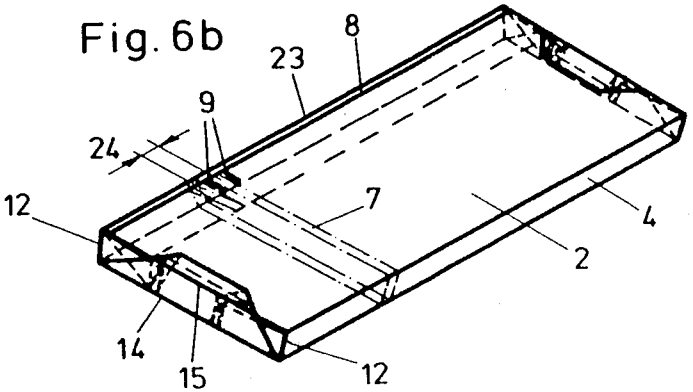
Figure 3B:
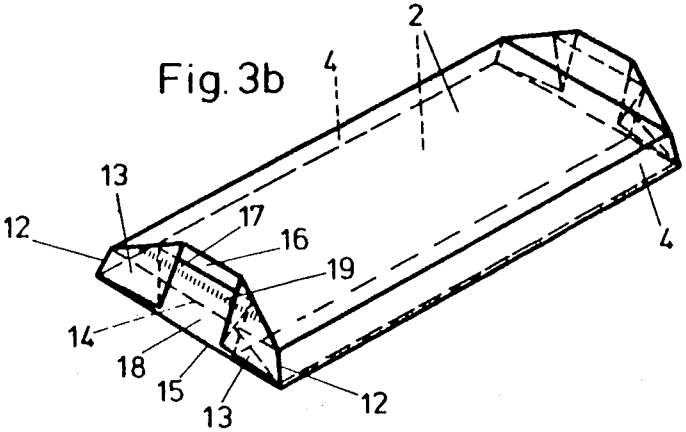
Figure 4B:
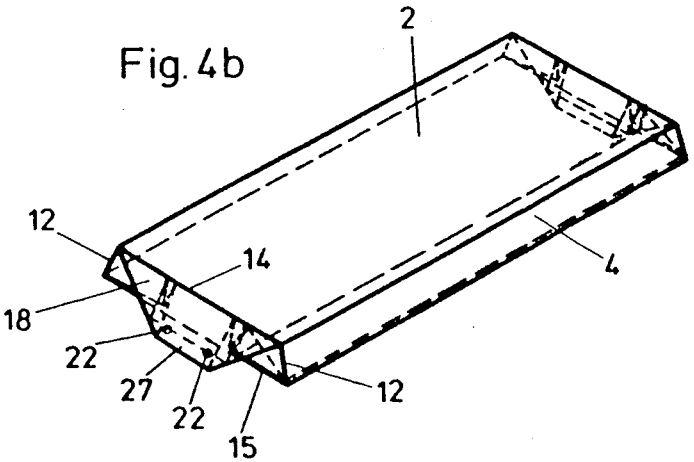

The folded edge zones 13, 16 and 17 are folded over along a line 20 which is parallel to the end face edge 15 to obtain a width 21 which is slightly smaller than the length of the short end face edges 12 and are provided with adhesive dots 22 as shown in FIG. 4*a*. Prior to applying the adhesive dots 22, this portion, if desired, may be additionally sealed with heating elements. Thereafter, the flat folded edge zones 13, 16 and 17 are folded over onto the end face 18 about the long end face edge 15 and pressed against the end face 18 as shown in FIG. 5*a* which thus illustrates the finished package. FIG. 6*a* shows the finished package as viewed from the bottom face thereof. The visible longitudinal edge 8 of the longitudinal seam 6 is placed adjacent the lateral edge 23 so that the package has on all sides a practically uninterrupted surface adapted to bear promotional messages and thus a further sleeve made, for example, of paper, may be dispensed with. The ends of the tear-open strips 7 have a slight lateral spacing 24 at the longitudinal edges 8 of the sheet 1 as shown in FIG. 6*a*. In this manner, the longitudinal sealing seam 6 is more airtight and also, the tearing-open of the strip 7 is facilitated. The end face closures folded onto the opposite end faces 18 reinforce the package and thus act as a shock absorber.

According to the embodiment illustrated in FIGS. *3b–6b*, the end closures are, similarly to FIG. *3a*, but in an opposite direction, folded flat against the edge face 18 and are provided with a sealing seam 19 as shown in FIG. *3b*. Here too, the flattened edge zones are folded about a long end face edge 14 as shown in FIG. *4b*. The flap 27 projecting beyond the other long end face edge 15 is folded about the edge 15 and is bonded with adhesive dots 22 onto the large face 2 adjoining the edge 15 as shown in FIGS. *5b* and *6b*.

The third preferred embodiment of the method according to the invention is illustrated in FIG. *4c* and continues from the step shown in FIG. *3a*. The longitudinal folded edge zones 13, 16 and 17 are directly folded onto the edge face 18 about the edge 15 rather than being first folded together. The flap 28 projecting beyond the long end face edge 14 is bonded by means of an adhesive dot onto the adjoining large face 2 as shown in FIG. *4c*.

It will be understood that the above description of the present invention is susceptible to various modifications, changes and adaptations, and the same are intended to be comprehended within the meaning and range of equivalents of the appended claims.

What is claimed is:

1. A method of packing a flat, angular item having two opposite large faces, two opposite side faces and two opposite end faces; each said end face being bounded by two short end face edges, a first long end face edge and a second long end face edge; comprising the following steps:

(a) laying a wrapper sheet about the two large faces and the side faces to obtain superposed longitudinal edge zones of the wrapper sheet and opposite terminal wrapper portions projecting beyond the end faces;

(b) bonding to one another said longitudinal edge zones by a longitudinal seam to obtain a fin seam;

(c) flattening said fin seam against one of said large faces;

(d) folding each terminal wrapper portion by folding a first terminal wrapper portion about said first long end face edge flat onto the respective said end face and folding a second terminal wrapper portion about each of the short end face edges onto said first terminal wrapper portion, whereby each terminal wrapper portion is coplanar with the respective end face and has an end part projecting beyond a respective said second long end face edge;

(e) sealing folded parts of each terminal wrapper portion to one another along a seam on the part of the terminal wrapper portion extending beyond said second end face edge; and (f) folding said end part of each terminal wrapper portion about said second long end face edge flat against the respective said end face.

2. A method as defined in claim 1, wherein prior to folding each terminal wrapper portion about a respective said second long end face edge, each folded terminal wrapper portion is folded over to have a width which at the most equals the length of the short end face edges.

3. A method as defined in claim 1, wherein subsequent to folding the terminal wrapper portions about respective said second long end face edges a part of the terminal wrapper portions projects beyond the respective said first long end face edges; further comprising the step of folding said part of the terminal wrapper portions about respective said first long end face edges onto the large face adjoining said first long end face edges.

* * * * *